US005378249A

United States Patent [19]

Morrison

[11] Patent Number: 5,378,249

[45] Date of Patent: Jan. 3, 1995

[54] BIODEGRADABLE LUBRICANT

[75] Inventor: David S. Morrison, The Woodlands, Tex.

[73] Assignee: Pennzoil Products Company, Houston, Tex.

[21] Appl. No.: 82,696

[22] Filed: Jun. 28, 1993

[51] Int. Cl.[6] ..... C10L 1/02; C10M 105/32

[52] U.S. Cl. ..... 44/388; 44/389; 252/56 S; 252/56 R

[58] Field of Search ..... 252/56 R, 56 S; 44/388, 44/389

[56] References Cited

U.S. PATENT DOCUMENTS

| | | | |
|---|---|---|---|
| 2,757,139 | 7/1956 | Matuszak et al. | 252/56 S |
| 4,402,841 | 9/1983 | Schieman . | |
| 4,601,840 | 7/1986 | Zehler et al. | 252/56 S |
| 4,994,196 | 2/1991 | Mineo et al. . | |

OTHER PUBLICATIONS

Kenbeek et al. "High Performance Ester-Based Two-Stroke Engine Oil", J. Synth. Lubr., vol. 8 (1991) pp. 83-101.

"Henkel Develops Biodegradable Engine Oil", *Lubication Engineering,* (Feb. 1993) p. 88.

"Two Cycle Lubricants", Henkel publication, (Apr. 1991) 4 pages.

"Biodegradable Lubricants", Unichema International publication, 26 pages year and month unknown.

"High Performance Ester Based Two-Stroke Oils", Unichema International publication, (Feb. 1990) 18 pages.

Kenbeek, D. et al. "High-Performance Ester-Based Two-Stroke Engine Oil", *J. Synth. Lubr.,* vol. 8, (1991) pp. 83-101 month unknown.

Randles, S. J. et al. "Environmentally Considerate Lubricants for the Automotive and Engineering Industries", *Spec. Publ.-R. Soc. Chem.,* 93 (Chem. Automot. Ind.), (1991) pp. 165-178 month unknown.

Kenbeek, D. et al. "Development of High Dilution, Low Pollution Outboard Oils", *J. Syntyh. Lubr.,* vol. 5, (1988) pp. 215-226 month unknown.

Versino, C. et al. "Biodegradability Test for Synthetic Esters", *J. Synth. Lubr, vol. 4, (1987) pp. 3-23 month unknown.* van der Waal, G. "Priolube 3999: Synthetic Base Fluid for Outboard 2-Stroke Engine Lubricants", Unichema International publication, (Feb. 1987) 11 pages.

*Primary Examiner*—Prince Willis, Jr.
*Assistant Examiner*—Cephia D. Toomer
*Attorney, Agent, or Firm*—Lowe, Price, LeBlanc & Becker

[57] ABSTRACT

A biodegradable two-cycle engine oil composition comprises about (a) 20 to 85 wt. % of a heavy ester or a mixture of heavy ester oils characterized by a kinematic viscosity of at least about 7.0 cSt at 100° C., (b) 10 to 85 wt. % of a light ester oil or a mixture of light ester oils characterized by a kinematic viscosity of less than about 6.0 cSt at 100° C., and optionally an additive, wherein the composition has a biodegradability of at least about 66% as measured by the CEC L-33-T-82 method.

18 Claims, No Drawings

BIODEGRADABLE LUBRICANT

FIELD OF THE INVENTION

This invention relates to biodegradable oil compositions especially suitable for engines, and in particular for use in two-cycle engines. Specifically, the present invention relates to biodegradable oil compositions comprising a combination of one or more heavy ester oils, one or more light ester oils and one or more additives, and which is overall at least virtually 66% biodegradable, and most preferably is at least 85% biodegradable.

BACKGROUND

The term "two-cycle" engine is commonly regarded as applying to small engines utilized for powering small electric generators, lawn mowers, tractors, pumps, chain saws, motorcycles, as marine outboard motors, and many similar applications where small, portable power units are required. The chief identifying characteristic of these small two-cycle engines relates to the fact that the lubricating oil is mixed with the gasoline and engine lubrication is provided by this oil-fuel mixture. Consequently, the requirements of satisfactory oil for small two-cycle engines are quite different from the requirements of quality oil for automobile, truck and bus engines. An oil rated as excellent for automobile engines would most likely be rated as unacceptable for outboard-motor use.

Basically, two-cycle engine oils are mixed with gasoline, with the result that the oil supplies lubrication in a highly diluted form, and also passes through the engine very quickly to be burned in the combustion chambers. Thus, a quality two-cycle engine oil must be designed to supply proper engine lubrication in highly diluted form, and should burn cleanly with a minimum of soot, ash or carbon formation.

Recent public concern regarding engine oils centers around the harmful effects of oil to the environment. Especially in regard to two-cycle outboard marine engines, the need for a biologically degradable engine oil cannot be overstated. Lakes, rivers, and oceans are becoming increasingly polluted as water traffic increases. In some areas, bans have been placed on the use of large outboard engines. In response, consumers are becoming more environmentally aware, and much interest has been shown in the development of environmentally friendly products. As of yet, little development has occurred towards production of environmentally safe two-cycle engine oils in the U.S. Thus, a substantial need exists for a high quality biodegradable two-cycle engine oil which will be readily accepted by the consumer.

Versino et al., *J Synth. Lubr.* 1987, 4, 3, report biodegradability test results for a variety of esters using Biochemical Oxygen Demand (BOD) and Chemical Oxygen Demand (COD) values along with extractions of the samples which remained after testing. Versino et al., however, do not disclose or suggest any engine oil formulation or an engine oil formulation comprising the combination of a heavy ester oil in combination with a light ester oil.

In Kenbeek et al., *J. Synth. Lubr.* 1988, 5, 215, Kenbeek and van der Waal of Unichema International stated that esters can be formulated into biodegradable outboard engine oils which pass TC-W requirements. Due to the polar functionalities of esters, these compounds adhere to metal surfaces and have better lubricity than hydrocarbons. However, the Kenbeek et al. engine oil composition requires the presence of a solvent, creating the problem of lowered biodegradability and flash point. Further, Kenbeek et al. do not recognize that an unexpectedly superior engine oil lubricant may be obtained by blending a heavy ester oil in combination with a light ester oil.

A second paper by Kenbeek and van der Waal in 1991 reports the performance of ester-based two-cycle oils in air cooled applications as well as in TC-W engine tests. See Kenbeek et al., *J. Synth. Lubr.* 1991, 8, 83. However, as above, Kenbeek et al. do not disclose an engine formulation comprising the combination of a heavy and light ester oil.

SUMMARY OF THE INVENTION

It is accordingly an object of the present invention to formulate an ester-based oil which is highly biodegradable.

It is a further object of the present invention to provide an ester-based, biodegradable oil which is solventless and has a high flash point.

It is still another object of the present invention to formulate an ester-based, biodegradable oil which is high in quality and is readily accepted by the consumer, and is fully miscible with gasoline.

In accordance with these and other objects of the invention, the present invention provides an oil formulation which comprises:

(a) about 20 to 85 wt. %, preferably 60 to 80 wt. %, of a heavy ester oil or mixture of heavy ester oils;

(b) about 10 to 85 wt. %, more preferably 15 to 50 wt. %, of a light ester oil or mixture of light ester oils; and (c) about 0.01 to 20 wt. %, preferably 5 to 18 wt. %, of one or more additives.

The biodegradable oil is suitable for use in engines, and in particular for use in two-cycle engines, and has special application in two-cycle out-board marine engines.

DETAILED DESCRIPTION OF THE INVENTION

According to the present invention, it has been found that generalizations may be made with regard to the biodegradability of hydrocarbons. The biodegradability of non-aromatic and non-cyclic compounds is higher than aromatic hydrocarbons. Unsaturated hydrocarbon chains are more biodegradable than hydrocarbon chains with saturation. Further, the presence of certain functional groups on specific locations can render a compound more biodegradable than its counterpart. For example, acyl alcohols are more biodegradable than the corresponding alkane or alkene. On the other hand, halogenation of certain hydrocarbons may cause them to be more resistant to degradation.

CEC L-33-T-82 is a test method developed by the Coordinating European Council (CEC) and is reported by the CEC in "Biodegradability of Two-Stroke Cycle Outboard Engine Oils in Water: Tentative Test Method", pp. 1–8 and incorporated herein by reference. Using CEC L-33-T-82, a test method of the Coordinating European Council (CEC), it has been determined that polyalphaolefins are 5 to 10% biodegradable, mineral oils are 15 to 30% biodegradable, and natural and modified vegetable oils are 70 to 95% biodegradable.

Esters are up to 95% biodegradable depending on the structure of the ester.

It has been unexpectedly found according to the present invention that hydrocarbons containing ester functionalities may be formulated into excellent lubricants. The lubricants provided by the present invention are highly biodegradable, are solventless, have a high flash point, are fully miscible with gasoline, are high in quality and readily accepted by the consumer. The biodegradable oil composition of this invention may be formulated from (a) about 20 to 85 wt. %, preferably about 60 to 80 wt. %, of a heavy ester oil or mixture of heavy ester oils;

(b) about 10 to 85 wt. %, more preferably about 15 to 50 wt. %, of a light ester oil or mixture of light ester oils; and (c) about 0.01 to 20 wt. %, preferably, about 5 to 18 wt. % of one or more additives.

More particularly, the oils of the present invention comprise a composition of:

(a) 20 to 85 wt. % of a heavy ester oil or mixture of heavy ester oils, wherein said heavy ester oil is characterized by a kinematic viscosity of at least about 7.0 cSt at 100° C.; and (b) 10 to 85 wt. % of a light ester oil or mixture of light ester oils, wherein said light ester oil is characterized by a kinematic viscosity of less than about 6.0 cSt at 100° C.;

(c) 0.01 to 20 wt. % of one or more additives; and wherein said composition has a biodegradability of at least about 66% as measured by the CEC L-33-T-82 method.

A heavy ester oil is defined herein as a compound having at least one ester functionality and a kinematic viscosity (kin vis) of at least about 7.0 cSt and preferably less than about 30 cSt at 100° C. Any heavy ester oil may be used which exhibits these characteristics and is at least about 66% biodegradable as measured by the CEC L-33-T-82 method, and most preferably about 95% biodegradable as measured by the CEC L-33-T-82 method.

A light ester oil is defined herein as a compound with at least one ester functionality and having a kinematic viscosity of less than about 6.0 cSt and more than about 0.1 cSt at 100° C. Any light ester oil may be used which exhibits these characteristics and is at least about 55%, and more preferably at least about 75% biodegradable, as measured by the CEC L-33-T-82 method.

The overall kinematic viscosity of the combined esters is about 6.0 to 10.0 cSt at 100° C. The biodegradable oil should have an overall biodegradability of at least about 66% as measured by the CEC L-33-T-82 method.

Biodegradation occurs when organic compounds and oxygen, in the presence of the proper microorganisms, produce carbon dioxide, water and new cell mass. The traditional methods of measuring organic matter to be biodegraded consists of analyzing the Biochemical Oxygen Demand (BOD), and the Chemical Oxygen Demand (COD). The BOD is defined as the amount of oxygen required by microorganisms to stabilize a given quantity of organic matter. The COD is defined as the amount of oxygen needed to decompose an organic sample to carbon dioxide in water regardless of how easily the substance is decomposed by microorganisms.

The Coordinating European Council (CEC) has developed a test method for determining the biodegradability of two-cycle outboard engine oils in water, the test being coded as CEC L-33-T-82. This test method measures the decrease in the amount of substrate due to microbial action. The biodegradability of a sample is determined by extraction of the organics (after the test period) with carbon tetrachloride or 1,1,2-trichlorotrifluoroethane. The organics are then analyzed by infrared C-H absorption of the sample. Biodegradability is assigned by comparing this absorption with that of a poisoned sample (a sample which exhibits no biodegradation). The International Council of Marine Industry Association (ICOMIA) standard 38–88 requires a two-cycle engine oil to be at least 66% biodegradable by the above CEC L-33-T-82 test method for the oil to be deemed biodegradable and ecologically friendly.

According to the present invention, it has been unexpectedly found that a high quality biodegradable oil composition is produced by combining 20 to 85 wt. % of a heavy ester oil having a kinematic viscosity of at least about 7.0 cSt at 100° C. with 10 to 85 wt % of a light ester oil having a kinematic viscosity of less than about 6.0 cSt at 100° C. The composition has an overall kinematic viscosity of preferably between about 6.0 to 10.0 cSt at 100° C. and a biodegradability of at least 66%, and preferably has a biodegradability of at least 75%, and more preferably has a biodegradability of at least 85% as measured by the CEC L-33-T-82.

The oil is particularly useful for use in engines, and more particularly for use in two-cycle engines wherein the gasoline is mixed with the lubricating oil to provide an oil-fuel mixture. The oil according to the present invention burns cleanly with a minimum of soot, ash and carbon formation, so that the engine is free from aggravated carbon deposits on the piston and cylinder heads, and spark plug fouling can be minimized. Further, the oil is biodegradable, and thus is particularly useful in two-cycle outboard engine motors.

It has been discovered that the use of a polyester oil or mixture of polyester oils as the heavy oil, in conjunction with a lighter ester oil or mixture of lighter ester oils, will form an excellent lubricant which is highly biodegradable. The heavy ester oil serves as the base fluid in the oil formulation. The light ester oil functions in place of conventional solvents which tend to lower the flash point, therefore, the formulation is prepared without the use of conventional solvents. Accordingly, the two-cycle engine oil has a high flash point, greater than 200° F. The light ester oil enhances miscibility with the fuel and decreases the overall viscosity of the formulation. Light ester oil fluids also provide good low temperature properties.

The preferred polyester oil (heavy oil) which may be used alone or in combination with other heavy ester oils in addition to the light ester oils is produced by the reaction of a triol with an acid and has the following formula:

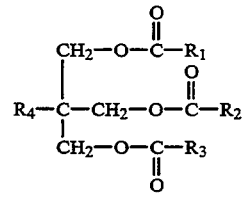

(I)

wherein $R_1$, $R_2$ and $R_3$ are individually selected from the group consisting of $C_{10}$ to $C_{30}$ hydrocarbons which may contain one or more of S, N, and O, and $R_4$ is selected from the group consisting of $C_1$ to $C_{10}$ hydrocarbons which may contain one or more of S, N and O. More preferably, $R_1$, $R_2$, and $R_3$ are branched or unbranched alkyl radicals having 13 to 20 carbon atoms, and $R_4$ is a branched or unbranched alkyl radical having 1 to 5 carbon atoms.

A more preferred heavyester is the reaction product of a triol with a saturated or unsaturated aliphatic carboxylic acid. Examples of saturated aliphatic carboxylic acids useful for the purposes of this invention include but are not limited to lauric acid, myristic acid, palmitic acid, stearic acid, arachidic acid, behenic acid and lignoceric acid. Examples of unsaturated aliphatic carboxylic acids useful for the purposes of this invention include but are not limited to obtusilic acid, caproleic acid, linderic acid, lauroleic acid, tsuzuic acid, physteric acid, myristoleic acid, palmitoleic acid, petroselinic acid, oleic acid, vaccenic acid, gadoleic acid, detoleic acid, erucic acid, selacholeic acid, ximenic acid, lumequeic acid, eleostearic acid, parinaric acid, arachidonic acid, clupanodonic acid, and ricinoleic acid. A preferred acid is branched stearic acid. A preferred heavy ester is trimethylolpropane isostearate, having the formula:

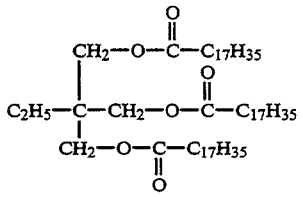

(II)

Trimethylolpropane isostearate is sold commercially under the tradename PRIOLUBE 3999. PRIOLUBE 3999 is characterized by a kin vis of 13.19 cSt at 100° C., a kin vis of 91.66 cSt at 40° C., a pour point of −20° C., a flash point of 300° C. and a biodegradability of about 95% by CEC L-33-T-82. In addition, it displays superb anti-scuff properties. Another trimethylolpropane isostearate is sold under the tradename EMERY 2951. EMERY 2951 exhibits a kin vis of 13.8 cSt at 100° C., a kin vis of 102.0 at 40° C., a pour point of −18° C., a flash point of 286° C. and a biodegradability of 93% by CEC L-33-T-82. These oils have superb biodegradability characteristics.

An additional heavy ester which is highly biodegradable and useful for this invention is trimethylolpropane trioleate, sold under the tradename EMERY 2964. EMERY 2964 exhibits a kin vis of 10.17 cSt at 100° C., a kin vis of 48.43 cSt at 40° C., a pour point of −40° C., a flash point of 312° C. and a biodegradability of 99% by CEC L-33-T-82. Trimethylolpropane trioleate may be used as a single heavy ester in combination with a light ester oil, or in combination with one or more heavy ester oils and one or more light ester oils.

The light ester is preferably the reaction product of an alcohol reacted with an acid, and preferably has the following formula:

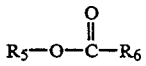

(III)

wherein $R_5$ and $R_6$ are individually selected from the group consisting of $C_1$ to $C_{20}$ hydrocarbons which may contain one or more of S, N and O.

More preferably, the light ester is the reaction product of a $C_5$ to $C_{15}$ branched alcohol reacted with an unbranched $C_5$ to $C_{15}$ aliphatic carboxylic acid. Examples of aliphatic carboxylic acids (saturated and unsaturated) include but are not limited to pelargonic acid, heptanoic acid, caprylic acid, hexanoic acid, lauric acid, lauroleic acid, capric acid, isovaleric acid, decanoic acid, 4-decenoic acid and 9-decenoic acid. Examples of alcohols (saturated and unsaturated) include but are not limited to isodecyl alcohol, pentyl alcohol, 4-methyl-1-pentanol, 4-penten-2-ol, neopentyl alcohol and 2-isobutyl-5-hexen-6-ol.

A particularly preferred light ester is isodecyl pelargonate having the formula

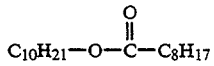

(IV)

formed by the reaction of isodecyl alcohol and pelargonic acid. Isodecyl pelargonate is sold under the tradename EMERY 2911 and has a biodegradability of about 97.6% as measured by the CEC L-33-T-82 method, a kinematic viscosity of 1.74 cSt at 100° C., a pour point of −100° C., and a flash point of 340° F.

Other preferred light ester oils which may be used alone or in combination with other light ester oils include but are not limited to pentyl decanate, neopentyl 9-decenoate, isodecyl caprylate and isodecyl decanate.

Examples of the first preferred oil composition comprising a heavy ester oil according to formula II and a light ester oil according to formula IV are set forth in Table I. Therein, the heavy ester oil comprises about 60 wt. % to 70 wt. % trimethylolpropane isostearate and about 20 wt. % to 30 wt. % isodecyl pelargonate, the remainder comprising one or more additives.

Examples of additional ester oils comprising the combination of two heavy ester oils according to formula (I) and a light ester oil according to formula IV are set forth in Table III. Therein, the heavy ester oil comprises about 10 wt. % trimethylolpropane isostearate and about 60 wt. % trimethylolpropane trioleate, and the light ester oil comprises about 20 wt. % isodecyl pelargonate, the remainder comprising one or more additives.

Additional ester oils comprise the combination of two or more light ester oils in combination with a heavy ester oil. A preferred formulation includes but is not limited to 5 wt. % pentyl decanate, 5 wt. % neopentyl 9-decenoate, 5wt. % isodecyl caprylate, 82wt. % trimethylol propane trioleate and 3 wt. % additives.

A further example of preferred biodegradable oil compositions includes a mixture of two heavy esters and a light ester, the first heavy ester preferably formed by the reaction of a linoleic acid dimer reacted with an alcohol and the second heavy ester is formed by the reaction of glycerol reacted with a carboxylic acid; the light ester is a dicarboxylic acid ester. An example of a preferred heavy ester is according to the formula:

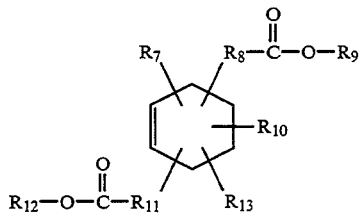

(V)

wherein $R_7$, $R_8$, $R_9$, $R_{10}$, $R_{11}$ and $R_{12}$ are individually selected from the group consisting of $C_3$ to $C_{15}$ hydrocarbons which may contain one or more of S, N and O, and $R_{13}$ may be H or $C_1$ to $C_4$ hydrocarbons. A preferred heavy ester according to the above formula is of the formula:

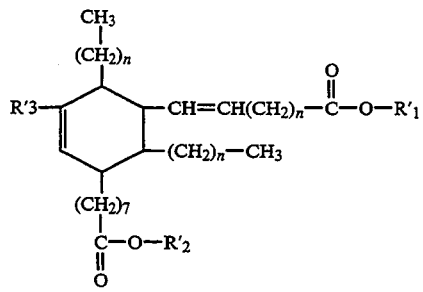

(VI)

wherein n is 4 to 9, $R'_2$ and $R'_2$ are hydrocarbon chains having 6 to 10 carbon atoms, and $R'_3$ is H, methyl, ethyl, or propyl.

A more preferred heavy ester occurs when $R'_3$ is H, n is 5, and $R'_1$ and $R'_2$ are 2-ethylhexyl. This di-2-ethylhexyl dimerate is sold under the tradenames PRIOLUBE 3985 and EMERY 2900. EMERY 2900 is characterized by a viscosity at 100° C. of 13.1 cSt, a viscosity of 83.0 cSt at 40° C., a flash point of 300° C. and a pour point of −63° C. EMERY 2900 is approximately 75% biodegradable according to CEC the L-33-T-82 method. PRIOLUBE 3985 is characterized by a viscosity at 100° C. of 12.2–13.2 cSt, a viscosity of 88 cSt at 40° C. a flash point of 280° C. and a pour point of −40° C. The second heavy ester oil includes diols and triols such as glycerol, ethylene glycol, propylene, glycol and pentaerythritol. A preferred structure of the second heavy ester is

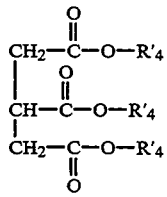

(VII)

wherein $R'_4$ is selected from the group consisting of $C_{10}$ to $C_{30}$ hydrocarbons. The more preferred second heavy ester occurs when R'4 is oleyl. This triester, glycerol trioleate (triolein) is sold under the tradenames TriSun and PRIOLUBE 1435. PRIOLUBE 1435 has a flash point of approximately 290° C., a kin vis of 8 cSt at 100° C. and 40 cSt at 40° C., and a pour point of −15° C.

This second heavy ester oil is preferably used in combination with the heavy ester oil according to formula V above, but may be used as a single heavy ester.

The light ester may be the reaction product of a carboxylic acid and an alcohol according to prior formula (III)

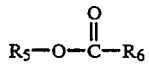

(III)

wherein $R_5$ and $R_6$ are defined as above.

Examples of the second preferred oil composition comprising heavy ester oils according to formulas VI and VII and a light ester oil according to formula II are found in Table 2. Therein, the heavy ester oil comprises about 50 to 60 wt. %, preferably 55 wt. % glycerol trioleate and about 10 to 20 wt. %, preferably 15 wt. % of di-2-ethylhexyl dimerate, and the light ester oil comprises about 10 to 20 wt. %, preferably 15 wt. % of isodecyl pelargonate, the remainder comprising one or more additives.

It is preferred that 20 to 85% of one or more of the heavy esters be used with 10 to 85% of one or more of the lighter esters. More preferably, 60 to 80% of the heavy esters and 15 to 50% of the lighter esters are used. The composition may also include up to 15% of a solvent if necessary, however, it is most preferred that no solvent is added. If a solvent is used, a preferred solvent is kerosene.

The composition may also include up to 20wt. % of an additive (preferably 5 to 18wt. %). The additive may be selected from one or more of the group consisting of detergents, rust inhibitors, anticorrosives, surfactants, pour point depressants, and wax modifiers. Preferred additive packages include OLOA 340R and OLOA 340RB, both of which contain isostearylamides as ashless detergents. Each also contains a rust inhibitor and a wax modifier.

A portion of the light ester oil may be replaced with mineral oil or the like in order to provide a reduced cost oil formulation, as long as the oil meets the biodegradability standards desired or required.

The following examples set forth preferred embodiments of the invention. In the examples and throughout the specification, parts are by weight unless otherwise indicated.

EXAMPLE I

The following formulations were prepared using combinations of trimethlolpropane isostearate (Priolube 3999) and isodecyl pelargonate (Emery 2911).

TABLE 1

| | Two-Cycle Oil Formulations (wt. %) | | | | | |
|---|---|---|---|---|---|---|
| Component | A | B | C | D | E | F |
| Priolube 3999 | 57.84 | 57.84 | 58.25 | 63.25 | 68.25 | 71.25 |
| Emery 2911 | 32.00 | 32.00 | 32.00 | 27.00 | 22.00 | 19.00 |
| OLOA 340R | 10.16 | | | | | |
| OLOA 340RB | | 10.16 | 9.75 | 9.75 | 9.75 | 9.75 |
| 100° C. Vis (cSt) | | 7.32 | 7.33 | 8.22 | 9.25 | 9.95 |
| 40° C. Vis (cSt) | | 38.0 | 37.9 | 45.0 | 53.8 | 60.0 |
| VI | | 161 | 162 | 159 | 155 | 152 |
| −25° Brookfield | 3160 | 2610 | 2500 | 3600 | 4700 | 5600 |

TABLE 1-continued

| Component | Two-Cycle Oil Formulations (wt. %) A | B | C | D | E | F |
|---|---|---|---|---|---|---|
| (cPs) | | | | | | |

EXAMPLE II

The following formulations were prepared using two base lubricants, di-2-ethylhexyl dimerate (Priolube 3985 or Emery 2900) and glycerol trioleate (TriSun), in conjunction with isodecyl pelargonate (Emery 2911) as the light ester oil.

TABLE 2

| Component | Two-Cycle Oil Formulations (wt. %) G | H |
|---|---|---|
| Priolube 3985 | 15.64 | |
| Emery 2900 | | 15.64 |
| TriSun | 56.28 | 56.72 |
| Emery 2911 | 17.48 | 17.48 |
| OLOA 340R | 10.16 | 10.16 |
| Acryloid 154-70 | 0.32 | |
| Plexol 305 | 0.12 | |
| Vis (100° C.) cSt | 7.65 | 7.60 |
| Brookfield vis (−25° C.), cPs | 7,110 | 6,260 |

EXAMPLE III

Table 3 lists formulations comprising a combination of two base lubricants, trimethylolpropane isostearate (Priolube 3999) and trimethylolpropane trioleate (Emery 2964), with isodecyl pelargonate (Emery 2911) as the light ester oil.

TABLE 3

| Component | Two-Cycle Oil Formulations (wt. %) I | J | K | L |
|---|---|---|---|---|
| Priolube 3999 | 10.00 | 10.00 | 10.00 | 10.41 |
| Emery 2964 | 62.36 | 59.84 | 59.84 | 59.84 |
| Emery 2911 | 17.48 | 20.00 | 20.00 | 20.00 |
| OLOA 340R | 10.16 | 10.16 | | |
| OLOA 340RB | | | 10.16 | 9.75 |
| 100° C. vis (cSt) | 8.07 | | 7.72 | 7.70 |
| 40° C. Vis (cSt) | | | 38.0 | 37.7 |
| VI | | | 178 | 180 |
| −25° Brookfield (cPs) | 2960 | 2810 | 2410 | 1850 |

EXAMPLES IV and V

Tables 4 and 5 are blend studies using Atlas Naphthenic 60 oil or Bright Stock (150), both mineral oils, in combination with trimethylolpropane isostearate (priolube 3999 or Emery 2951) and/or trimethylolpropane trioleate (Emery 2964) as the heavy ester oils, and isodecyl pelargonate (Emery 2911) as the light ester oil. These oils suggest a reduced cost oil formulation by substituting a portion of the heavy ester oil or the light ester oil (up to one-half) with mineral oil (Table 4) or all of the light ester oil (Table 5).

TABLE 4

| Component | Two-Cycle Oil Formulations (wt. %) M | N | O | P | Q | R |
|---|---|---|---|---|---|---|
| Emery 2964 | 61.84 | 59.84 | | 63.84 | | 59.84 |
| Priolube 3999 | 8.00 | | | | 57.84 | 10.00 |
| Emery 2951 | | | 65.84 | | | |
| Bright-Stock (150) | 4.00 | 10.00 | 4.00 | 8.00 | | |
| Atlas N-60 | | | | | 16.00 | 10.00 |
| Emery 2911 | 16.00 | 20.00 | 20.00 | 18.00 | 16.00 | 10.00 |
| OLOA 340RB | | | | | 10.16 | 10.16 |
| OLOA 340R | 10.16 | 10.16 | 10.16 | 10.16 | | |
| 100° C. Vis (cSt) | 8.49 | 7.96 | 9.19 | 8.20 | 7.88 | 8.04 |
| 40° C. Vis (cSt) | | | | 42.5 | 45.3 | 42.2 |
| VI | | | | 171 | 145 | 167 |
| −25° Brookfield (cPs) | 3760 | 2860 | 5100 | | 3775 | 2350 |

TABLE 5

| Component | Two-Cycle Oil Formulations (wt. %) S | T |
|---|---|---|
| Priolube 3999 | 72.25 | |
| Emery 2964 | | 72.25 |
| Atlas N-60 | 18.00 | 18.00 |
| OLOA 340RB | 9.75 | 9.75 |
| 100° C. vis (cSt) | 11.5 | 8.65 |
| 40° C. vis (cSt) | 79.7 | 45.6 |
| VI | 136 | 171 |
| −25° Brookfield (cPs) | 13,500 | 3450 |

EXAMPLE VI

Table 6 is a blend study conducted on formulation G (Table 2), in which the isodecyl pelargonate (Emery 2911) light ester is substituted with Emery 3002, a PAO. (100° C. vis=1.70 cSt, pour point=−68° C., flash point=320° F.).

TABLE 6

| Component | Two-Cycle Oil Formulations (wt. %) U | V | W |
|---|---|---|---|
| Priolube 3985 | 15.64 | 15.64 | |
| Emery 2900 | | | 15.64 |
| TriSun | 56.28 | 56.28 | 56.72 |
| Emery 3002 | 17.48 | | |
| Emery 2911 | | 17.48 | 17.48 |
| OLOA 340R | 10.16 | 10.16 | 10.16 |
| Acryloid 154-70 | 0.32 | 0.32 | |

TABLE 6-continued

| Component | Two-Cycle Oil Formulations (wt. %) U | V | W |
|---|---|---|---|
| Plexol 305 | 0.12 | 0.12 | |
| Vis (100° C.) cSt | 7.52 | 7.65 | 7.60 |
| Brookfield vis (−25° C.), cPs | 5,400 | 7,110 | 6,260 |

EXAMPLE VII

Table 7 discloses the preferred oil formulation.

TABLE 7

| Component | Preferred Oil Formulation Supplier | Wt % | Vol % |
|---|---|---|---|
| Priolube 3999 | Unichema | 58.25 | 57.10 |
| Emery 2911 | Henkel/Emery | 32.00 | 33.25 |
| OLOA 340RB | Chevron Chemical | 9.75 | 9.45 |

This formulation has the following properties:

TABLE 8

| Properties of High Flash Biodegradable Two-Cycle Oil | |
|---|---|
| API Gravity @ 60° F. | 24.5 |
| Density @ 60° F. | 0.9059 |
| Density @ 20° C. | 0.9032 |
| PMCC Flash Point (°F.) | >230 |
| Pour Point (°C.) | −36 |
| Sp. Grav. @ 60° C. | 0.9068 |
| VI | 160 |
| Vis @ 100° C. | 7.32 |
| Vis @ 40° C. | 38.30 |
| Sulfated Ash (%) | 0 |
| Nitrogen (%) | 0.53* |

*Calculated from a total combustion nitrogen value of 4722 μg/ml and a density of 0.9032.

This formulation was submitted to an independent testing laboratory for the National Marine Manufacturers Association (NMMA) TC-WII TM test protocol. The following tests were run:

(1) NMMATC-W II Rust Test. In this test, the candidate lubricant's rust inhibition properties are evaluated versus a reference oil.

(2) SAE Miscibility Test. This test determines the miscibility of the oil with gasoline in accordance with SAE J-1536.

(3) NMMA TC-W II Fluidity Test. This bench test determines the oil's low temperature fluidity by measuring its −25° C. Brookfield viscosity.

(4) NMMA TC-W II Filterability Test. This bench test determines the lubricant's ability to remain fluid when contaminated with water and calcium sulfonate additive-containing oils (i.e., Citgo oil no. 93511).

Table 9 discloses the results of the NMMA tests.

TABLE 9

| Test | NMMA Bench Tests Candidate | Reference | Limit | Result |
|---|---|---|---|---|
| Miscibility (Inversions, −25° C.) | 58 | 99 | <109 | Pass |
| Filterability (% Increase in Flow Time) | +2.91 | — | <20 | Pass |
| Rust (% Area) | 0.53 | 1.76 | <1.76 | Pass |
| Fluidity (Brookfield, cPs, −25° C. | 2370 | — | <7500 | Pass |

The formulation was tested in various engine tests. These are as follows:

(1) ASTM Lubricity Test (D-4863). This engine test determines the lubricity of an oil based on the torque drop when cooling is removed.

(2) NMMA TC-W II General Performance Test. This engine test evaluates the detergency and general performance of a two-cycle oil.

(3) ASTM Preignition Test (D-4858). The tendency of an oil to promote preignition is determined in this engine test. The results of the test are as follows:

TABLE 10

| Test | NMMA Engine Tests Candidate | Reference | Limit | Result |
|---|---|---|---|---|
| Tightening/ Lubricity Avg. Torque Loss | 3.92 | 4.87 | <4.87 | Pass |
| Detergency & General Performance | | | | |
| Avg. Piston Varnish | 8.4 | 9.0 | ≧8.4 | Pass |
| Avg. Ring Sticking | 9.2 | 9.2 | ≧8.6 | Pass |
| Spark Plug Fouling | 0 | 0 | ≦1 | Pass |
| Preignition | 0 | 0 | 0 | Pass |
| Exhaust Port Blockage (%) | 1 | 1 | <1.1 | Pass |
| Preignition | 1 Major | 3 Major | <1 Major | Pass |

Two-cycle engines find numerous applications in small motors utilized for powering small electric generators, lawn mowers, tractors, pumps, chain saws, motorcycles, as marine outboard motors, and many similar applications where small, portable power units are required.

The biodegradable oil according to the present invention is especially useful as a two-cycle engine oil, and is particularly useful for two-cycle out-board engine motors due to the excellent biodegradability characteristics. The oil mixed with the gasoline lubricates the internal parts of the power head while the gasoline is the fuel necessary for combustion.

The fuel used in two-cycle engines is gasoline intermixed with a small amount of oil. For normal operation, the oil and gasoline should be mixed in the proportions recommended by the engine manufacturer. These proportions may vary a great deal, depending on the size (horse-power rating) and other factors. Using the correct gas and oil mixture is of the utmost importance for top performance and trouble-free operation.

Depending on the engine, the ratio of fuel to oil may vary from 100:1 to 10:1, usually from 50:1 to 18:1. Some engines require a 25:1 fuel/oil mixture ratio. The addition of more oil to the fuel mixture than recommended by the engine builder provides no better engine lubrication and may cause harm.

It is essential that the fuel and oil be readily miscible so that the gasoline and oil will more thoroughly mix and stay mixed, even when the tank is allowed to stand idle for indefinite periods. Otherwise, gasoline-oil separation puts a layer of oil at the bottom of the tank, with gasoline at the top and various proportions of gasoline and oil between. Since the fuel pick-up is located at the bottom of the tank, the engine may get a high proportion of oil when the tank is full and almost straight gasoline when the tank is nearly empty.

The biodegradable engine oil of the present invention is superb for achieving these objectives. The ester oil composition is completely miscible with gasoline, readily forming a uniform mixture which remains uniform even after long periods of time without agitation. Accordingly, the present invention represents a significant achievement in the biodegradable lubricant field, especially in regard to two-cycle engines.

Of course, use of the biodegradable oil according to the present invention is not limited to engines. The biodegradable oil may have use in many other applications besides lubrication such as a cooking oil, heating oil, in cosmetics, canning, lotions, toys, pharmaceuticals, surgery, plastic compositions, plastic molding, etc.

Other variations and modifications of the invention as described herein in detail will be apparent to those skilled in the art and are intended to be comprehended by the present description and claims.

What is claimed is:

1. A biodegradable oil composition comprising:

(a) 20 to 85 wt. % of a heavy ester oil or mixture of heavy ester oils, wherein said heavy ester oil is characterized by a kinematic viscosity of at least about 7.0 cSt at 100° C., and (b) 10 to 85 wt. % of a light ester oil or mixture of light ester oils, wherein said light ester oil is characterized by a kinematic viscosity of less than about 6.0 cSt at 100° C.;

wherein said composition has a biodegradability of at least about 66% as measured by the CEC L-33-T-82 method.

2. The biodegradable oil composition according to claim 1, wherein the composition has a biodegradability of at least about 75% as measured by the CEC L-33-T-82 method.

3. The biodegradable oil composition according to claim 1, wherein (a) the heavy ester comprises the reaction product of a polyol reacted with a carboxylic acid, and (b) the light ester comprises the reaction product of a branched alcohol reacted with a carboxylic acid.

4. The biodegradable oil composition according to claim 3, wherein (a) the heavy ester comprises a triester having the formula

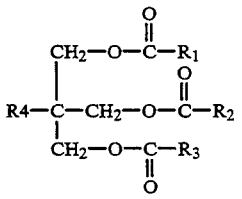

wherein $R_1$, $R_2$ and $R_3$ are individually selected from the group consisting of $C_{10}$ to $C_{30}$ hydrocarbons which may contain one or more of S, N and O;

and $R_4$ is selected from the group consisting of $C_1$ to C10 hydrocarbons which may contain one or more of S, N and O; and (b) the light ester comprises an ester of the formula

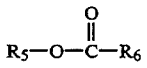

wherein $R_5$ and $R_6$ are individually selected from the group consisting of $C_1$ to $C_{20}$ hydrocarbons which may contain one or more of S, N and O.

5. The biodegradable oil composition according to claim 4, wherein $R_1$, $R_2$ and $R_3$ are branched or unbranched alkyl radicals having 13 to 20 carbon atoms, $R_4$ is a branched or unbranched alkyl radical having 1 to 5 carbon atoms, and $R_5$ and $R_6$ are branched or unbranched alkyl radicals having 5 to 15 carbon atoms.

6. The biodegradable oil composition according to claim 5, wherein the heavy ester comprises a triester of the formula

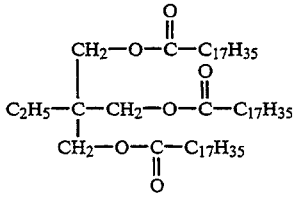

and wherein the $C_{17}H_{35}$ alkyl groups are branched hydrocarbons.

7. The biodegradable oil composition according to claim 5, wherein the light ester comprises

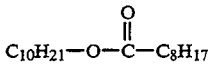

the $C_{10}H_{21}$ alkyl group comprises a branched hydrocarbon, and the $C_8H_{17}$ alkyl group comprises a straight chain hydrocarbon.

8. The biodegradable oil composition according to claim 1, wherein (a) one heavy ester is the reaction product of a linoleic acid dimer reacted with an alcohol;

(b) a second heavy ester is the reaction product of glycerol reacted with a carboxylic acid; and (c) the light ester is a carboxylic acid ester of the formula:

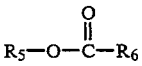

wherein $R_5$ and $R_6$ are individually selected from the group consisting of C1 to C20 hydrocarbons which may contain one or more of S, N, and O.

9. The biodegradable oil composition according to claim 1, wherein (a) one heavy ester comprises an ester of the formula:

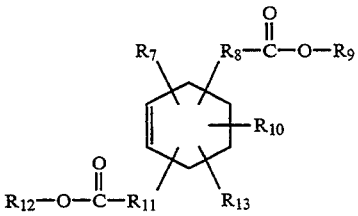

(V)

wherein $R_7$, $R_8$, $R_9$, $R_{10}$, $R_{11}$ and $R_{12}$ are individually selected from the group consisting of $C_3$ to $C_{15}$ hydrocarbons which may contain one or more of S, N, and O; and $R_{13}$ may be H, or $C_1$ to $C_4$ hydrocarbons; and (b) the second heavy ester comprises an ester of the formula

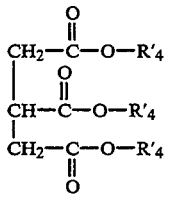

wherein $R'_4$ is selected from the group consisting of $C_{10}$ to $C_{30}$ hydrocarbons; and (c) the light ester comprises an ester of the formula

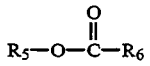

wherein $R_5$ and $R_6$ are individually selected from the group consisting of $C_1$ to $C_{20}$ hydrocarbons which may contain one or more of S, N and O.

10. The biodegradable oil composition according to claim 9, wherein (a) $R_7$, $R_8$, $R_9$, $R_{10}$, $R_{11}$, and $R_{12}$ are branched or unbranched, alkyl radicals having 3 to 15 carbon atoms, and (b) $R'_4$ is a branched or unbranched saturated or unsaturated alkyl radical having 10 to 30 carbon atoms, and (c) $R_5$ and $R_6$ are branched or unbranched alkyl radicals.

11. The biodegradable oil composition according to claim 10, wherein (a) the heavy ester comprises an ester of the formula

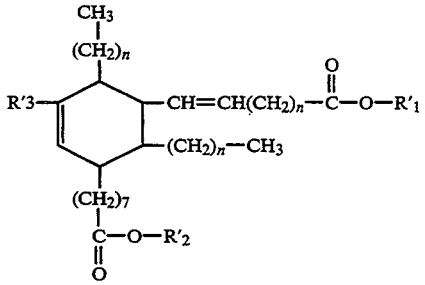

wherein n is 4 to 9, $R'_1$ and $R'_2$ are hydrocarbon chains having 6 to 10 carbon atoms, and $R'_3$ is H, methyl, ethyl, or propyl, and (b) a second heavy ester comprising an ester according to the formula

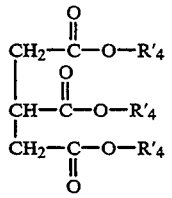

wherein $R'_4$ is a hydrocarbon chain having 10 to 30 carbon atoms, and (c) $R_5$ and $R_6$ are branched hydrocarbons having 5 to 15 carbon atoms.

12. The biodegradable oil composition according to claim 11, wherein (a) $R'_3$ is H, n is 5, and $R'_1$ and $R'_1$ are 2-ethylhexyl, and (b) $R'_4$ is oleyl, and (c) the light ester comprises isodecyl pelargonate.

13. The biodegradable oil composition according to claim 1, consisting essentially of:

(a) 60 to 80 wt. % of one or more polyol esters, (b) 15 to 50 wt. % of one or more aliphatic carboxylic acid esters, (c) 0 to 15 wt. % of a solvent, and (d) 0.01 to 20 wt. % of an additive, wherein the composition has a biodegradability of at least about 66% as measured by the CEC L-33-T-82 method.

14. The biodegradable oil composition according to claim 13, further comprising 0.01 to 20 wt. % of one or more additives, wherein the additive is selected from the group consisting of detergents, rust inhibitors, anti-corrosives, surfactants, pour point depressants, and wax modifiers.

15. The biodegradable oil composition according to claim 1, wherein the heavy ester oil comprises about 60 wt. % to 70 wt. % trimethylolpropane isostearate and about 20 wt. % to 30 wt. % isodecyl pelargonate.

16. The biodegradable oil composition according to claim 1, wherein the heavy ester oil comprises about 55 wt. % glycerol trioleate and about 15 wt. % of di-2-ethylhexyl dimerate, and the light ester oil comprises about 15 wt. % of isodecyl pelargonate.

17. The biodegradable oil composition according to claim 1, wherein the heavy ester oil comprises about 10 wt. % trimethylolpropane isostearate and about 60 wt. % trimethylolpropane trioleate, and the light ester oil comprises about 20 wt. % isodecyl pelargonate.

18. A gasoline/oil mixture comprising: a biodegradable oil composition of (a) 20 to 85 wt. % of a heavy ester oil or mixture of heavy ester oils, wherein said heavy ester oil is characterized by a kinematic viscosity of at least about 7.0 cSt at 100° C.;

(b) 10 to 85 wt. % of a light ester oil or mixture of light ester oils, wherein said light ester oil is characterized by a kinematic viscosity of less than about 6.0 cSt at 100° C.; wherein said biodegradable oil composition has a biodegradability of at least about 66% as measured by the CEC L-33-T-82 method; and (c) 0.01 to 20 wt. % of one or more additives; said additives being selected from the group consisting of detergents, rust inhibitors, anti-corrosives, surfactants, pour point depressants, wax modifiers and mixtures thereof; and gasoline, wherein said oil is mixed with gasoline in a gasoline/oil ratio in the range of 100:1 to 10:1.

* * * * *